US005469914A

United States Patent [19]

Davison et al.

[11] Patent Number: 5,469,914

[45] Date of Patent: Nov. 28, 1995

[54] ALL-WELDED PLATE HEAT EXCHANGER

[75] Inventors: Roger C. Davison; Achint P. Mathur, both of Wichita Falls, Tex.

[73] Assignee: Tranter, Inc., Augusta, Ga.

[21] Appl. No.: 76,110

[22] Filed: Jun. 14, 1993

[51] Int. Cl.[6] ..... F28D 9/02; F28F 3/08

[52] U.S. Cl. ..... 165/166; 165/165

[58] Field of Search ..... 165/165, 166

[56] References Cited

U.S. PATENT DOCUMENTS

| | | | |
|---|---|---|---|
| 2,361,691 | 10/1944 | Jendrassik | 165/166 |
| 3,148,442 | 9/1964 | Gier, Jr. | 165/166 |
| 3,463,222 | 8/1969 | Grames | 165/166 |
| 3,517,733 | 6/1970 | Tasker et al. | 165/166 |
| 4,043,388 | 8/1977 | Zebuhr | 165/166 |
| 4,249,597 | 2/1981 | Carey | 165/166 |
| 4,343,355 | 8/1982 | Goloff et al. | 165/166 |
| 4,351,391 | 9/1982 | Eberhardt | 165/154 |
| 4,556,105 | 12/1985 | Boner | 165/165 |
| 4,569,391 | 2/1986 | Hulswitt et al. | 165/167 |
| 4,688,631 | 8/1987 | Peze et al. | 165/166 |
| 4,696,342 | 9/1987 | Yamauchi et al. | 165/152 |
| 4,815,534 | 3/1989 | Fuerschbach | 165/167 |
| 5,025,856 | 6/1991 | VanDyke et al. | 165/167 |
| 5,069,276 | 12/1991 | Seidel | 165/166 |
| 5,301,747 | 4/1994 | Daschmann et al. | 165/166 |

FOREIGN PATENT DOCUMENTS

| | | | |
|---|---|---|---|
| 1183834 | 3/1985 | Canada . | |
| 4100940 | 11/1991 | Germany | 165/166 |
| 798535 | 7/1958 | United Kingdom | 165/166 |

*Primary Examiner*—Leonard R. Leo

*Attorney, Agent, or Firm*—Barnes, Kisselle, Raisch, Choate, Whittemore & Hulbert

[57] ABSTRACT

A plate heat exchanger having a stack of plates with spaces between the plates defining passages for hot and cold fluids. The ends of the plates define inlet and outlet openings for the fluid passages. The openings are enlarged by bending the end of one of the two plates for each flow path away from the corresponding end of the other of these plates and welding it to an adjacent plate. Preferably the ends of the plates are triangular, or V-shaped, to lengthen the openings along each edge of the V.

6 Claims, 7 Drawing Sheets

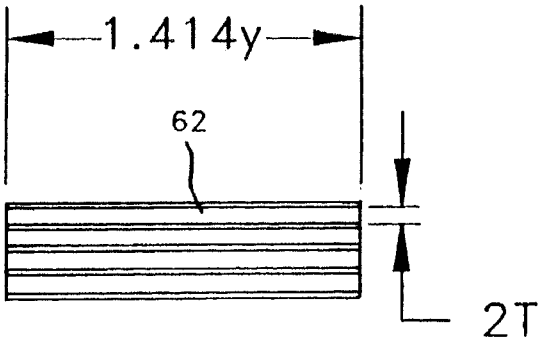
FIG.9
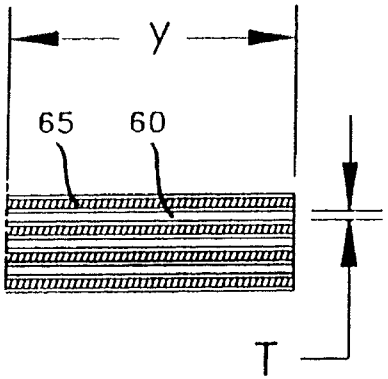
FIG.8
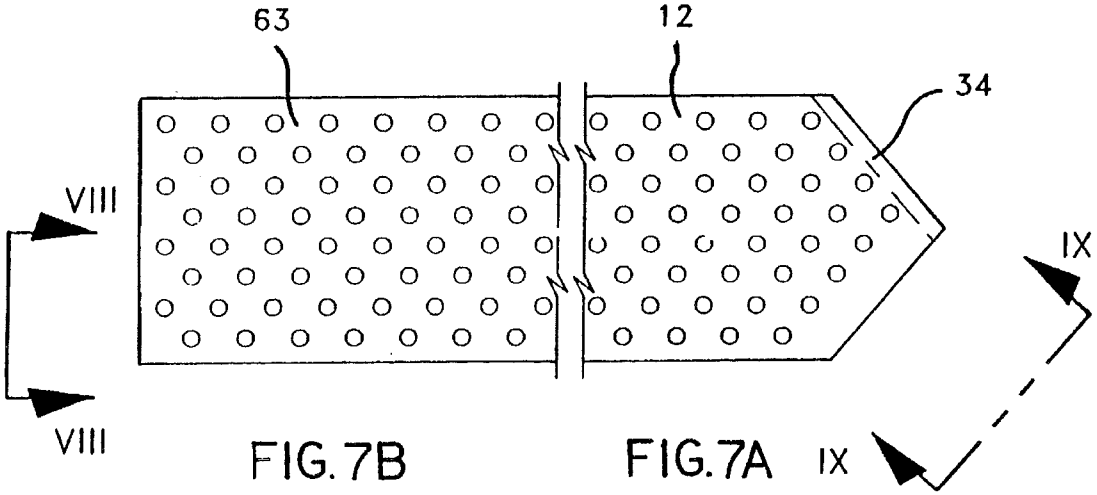
FIG.7A
FIG.7B

"A" PLATE
"B" PLATE

XIV
XV
XVI
XVII
XVIII
XX
80
82
86
88
89
90
92
93
94
100
101
102
105
106
108
110
112

ALL-WELDED PLATE HEAT EXCHANGER

This invention relates generally to heat exchangers and refers more particularly to a compact, welded plate heat exchanger.

BACKGROUND AND SUMMARY

Welded plate heat exchangers are commonly made of flat, parallel plates sandwiched and welded between two cover panels. Two fluids, one relatively hot and the other relatively cold, are passed between alternate plates for heat transfer. The narrow gaps between plates causes the flow paths of both the hot and cold fluids to go down to boundary layer thickness, eliminating the wasted center core of fluid which is pumped through, but not heated or cooled, in standard shell and tube heat exchangers. Plate heat exchangers require less space than shell and tube heat exchangers, and transfer heat at a much higher rate.

The heat exchanger of this invention has among its many features enlarged inlet and outlet openings for the flow paths between plates, thereby substantially reducing the pressure drop and pumping cost. The ends of the plates could be square but are preferably triangular, or V-shaped, lengthening the opening along each edge of the V. This opening is enlarged further by bending the opening-forming edge of one of the two plates for each flow path away from the corresponding edge of the other of those plates and welding it to an adjacent plate.

The heat exchanger of this invention is preferably of all welded construction, is compact, light weight, low in cost, operates at low fluid volume, has a high pressure rating, high performance and high efficiency.

It is an object of this invention to provide a plate heat exchanger having some or all of the above features.

Another object is to provide a plate heat exchanger which is of relatively simple construction, rugged and durable in use, and easy to manufacture and assemble.

Other objects, features and advantages of the invention will become more apparent as the following description proceeds, especially when considered with the accompanying drawings.

BRIEF DESCRIPTION OF THE DRAWINGS

FIG. 7A is a fragmentary view of a heat exchanger plate used in FIGS. 1, 2 and 2A, showing the triangular end configuration.

FIG. 7B is a fragmentary view of a heat exchanger plate without the triangular end configuration.

FIG. 8 is a view taken on the line VIII—VIII in FIG. 7B.

FIG. 9 is a view taken on the line IX—IX in FIG. 7B.

DETAILED DESCRIPTION

Referring now more particularly to the drawings, the heat exchanger 10 is shown as generally rectangular, although other shapes are possible.

Figure 2:
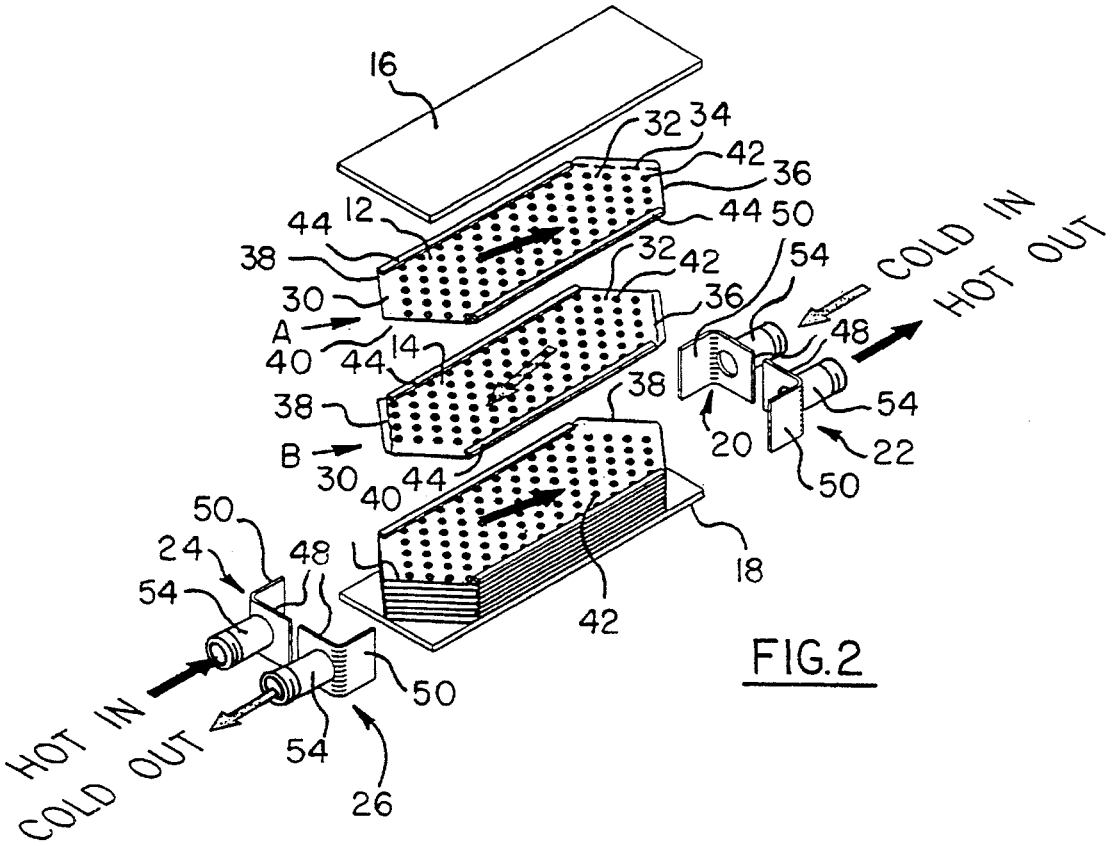
FIG. 2 is an exploded perspective view of the heat exchanger of FIG. 1.

FIG. 2 is an exploded view showing the various components of the heat exchanger, including a plurality of identical interior "A" plates 12, a plurality of identical interior "B" plates 14, a top cover panel 16, a bottom cover panel 18, and end caps 20, 22, 24 and 26. The "A" plates 12 and "B" plates 14 are stacked in interleaved or alternated relationship, namely ABAB etc.

The "A" and "B" plates 12 and 14 have parallel side edges 28 and triangular or V-shaped ends 30, 32. End 32 of each plate has edges 34 and 36 which preferably slant at a 45° angle to the longitudinal centerline of the plate and meet at the apex of the V on the longitudinal centerline. End 30 of each plate has edges 38 and 40 which also preferably slant at a 45° angle to the longitudinal centerline of the plate and meet at the apex of the V on the longitudinal centerline.

The top and bottom cover panels 16 and 18 are generally identical, rectangular members having the same width as plates 12 and 14 and a length substantially equal to the length of plates 12 and 14 measured from apex to apex.

The interior "A" and "B" plates 12 and 14 and top and bottom cover panels 16 and 18 are stacked in substantially exact overlying relationship with their edges at each side superimposed one above the other, and the apices of the V-shaped ends of the interior plates and the end edges of the top and bottom cover panels superimposed one above the other.

The interior "A" and "B" plates 12 and 14 each have a plurality of dimples 42, which are dents or deformations in the otherwise flat main body portions thereof. The dimples in adjacent plates are staggered or offset so that they do not nest. Thus the dimples of one plate provide contact against the flat main body portion of an adjacent plate to establish an equal, predetermined spacing between the plates and between the top and bottom plates and the cover panels 16 and 18.

Filler strips 44 are placed between the plates and panels and extend along the full length of the side edges to close the sides of the spaces therebetween. When the plate pack is tightened to the final dimension so that metal-to-metal contact occurs between adjacent dimpled plates and panels, the side edges are welded to the filler strips.

End caps 20–26 are each 90° L-shaped members which fit between the cover panels 16 and 18 at the corners thereof. Each end cap has a transverse leg 48 extending from the apices of the interior plates along the end edges of the cover panels and a longitudinal leg 50 extending along the side edges of the cover plates and butting up to extremities of the side edges of the interior plates and of the filler strips 44. The two legs of each end cap meet at a corner of the cover panels.

The end caps cooperate with the cover panels and interior plate ends in defining four triangular fluid manifolds 52. The end caps are welded to the cover panels and seal the manifolds along these weld lines and also at the ends of the end cap legs where they contact the sides of the interior plates and the apices at the ends thereof. Each end cap has a tubular fitting 54 communicating with one of the manifolds.

Alternate spaces 56 between the plates and panels provide paths for the passage of a first fluid (for example a hot liquid) and the remaining passages 58 are for a second fluid (for example a cold liquid). The inlets and outlets to these passages extend along the end edges of the V at each end of the plates.

Figure 6:
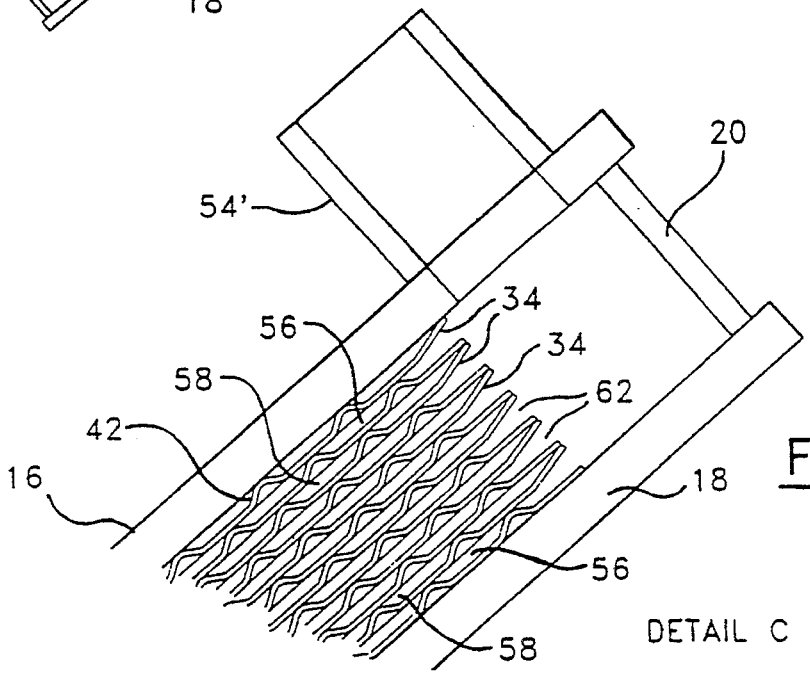
FIG. 6 is an enlargement of Detail C in FIG. 5.

Diagonally opposite end edges 34 and 40 of each "A" plate for a space 56 are bent up by an amount equal to the draw depth of the dimples and welded to the corresponding end edge of the next "B" plate for a space 58 in the stack and welded thereto. The edges 34 and 40 of the top plate in the stack are bent up and welded to the top cover panel 16 (See FIG. 6 Detail C ).

The diagonally opposite end edges 36 and 38 of each "B" plate for a space 58 are bent up by an amount equal to the draw depth of the dimples and welded to the corresponding end edge of the next "A" plate for a space 56 in the stack and welded thereto.

The fluid in the passages between plates follows crossing, countercurrent diagonal flow paths, maximizing heat transfer contact area with the plates. These flow paths are interrupted by the dimples which produce turbulence for greater heat transfer.

The "A" and "B" plates are identical before bending of the end edges 34–40. The "A" plates have the edges 34 and 40 bent, whereas the "B" plates have the edges 36 and 38 bent.

The bending and welding of the end edges accomplishes two purposes. First, there is a widening of the inlet and outlet openings for each fluid passage. The widened openings are shown at 62 in FIGS. 6 and 9 and the width is designated 2T. Second, the hot passages are sealed off from communication with the manifolds of the cold passages and the cold passages are sealed off from communication with the manifolds of the hot passages.

It should also be noted that the inlets and outlets extend from the extremities of the sides of the interior plates to the apex of the V at the ends of the interior plates (See FIGS. 7A and 9). Because these inlets and outlets extend along the 45° angled edges of the triangular plate ends, the inlets are extended in length by an amount equal to 1.414 times what they would be if the plate ends were square cut. FIGS. 7B and 8 illustrate the size of the inlet openings 60 where the plate end 63 is square cut and the plate edges are not bent but rather have filler strips 65 to seal off adjacent passages. The openings are shorter and narrower. The width of the opening 60 is designated T, approximately one-half the width of the opening 62 in FIG. 9.

Figure 2A:
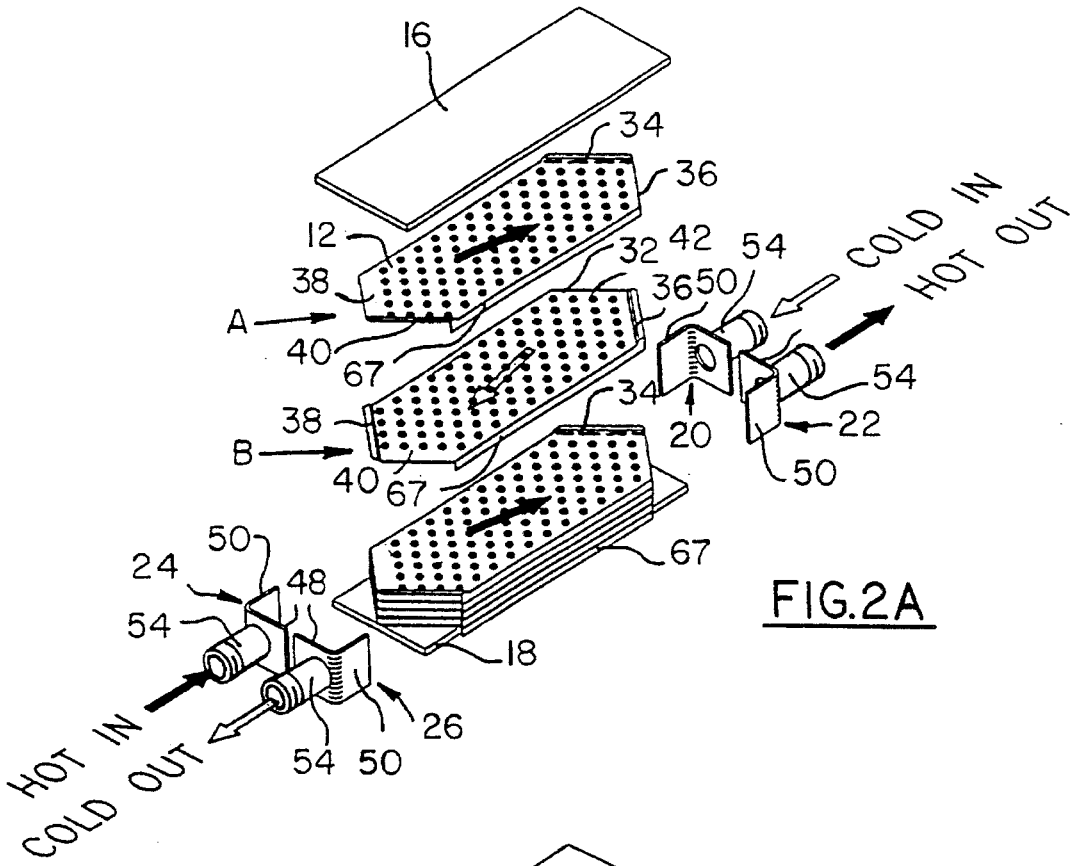
FIG. 2A is an exploded perspective view of a heat exchanger of modified construction.

FIG. 2A shows a modification in which the side filler strips 44 in the FIG. 2 form of the invention are omitted and instead the side edges of the plates 12 and 14 have downturned flanges 67 which nest with and are welded to the adjacent plates to close the sides of the fluid passages. Otherwise, the heat exchanger in FIG. 2A is like that in FIG. 2.

Figure 2B:
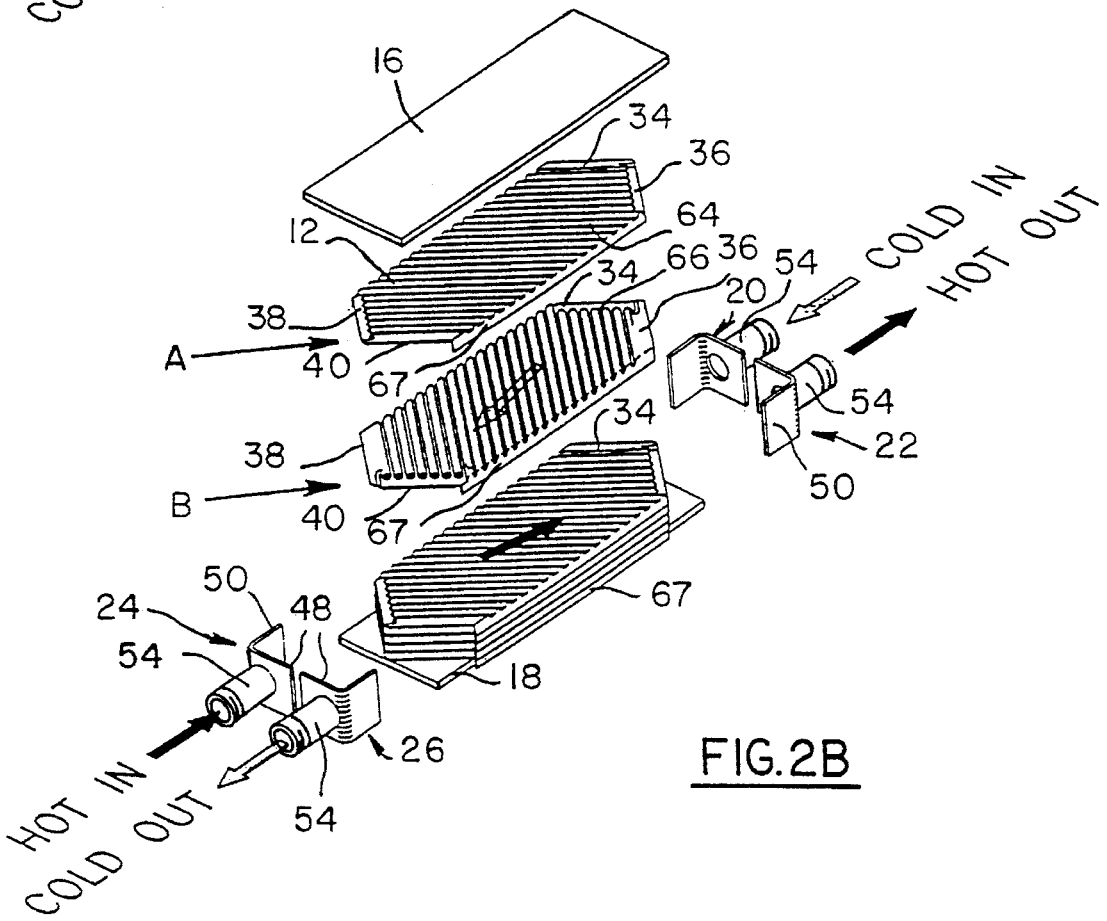
FIG. 2B is an exploded perspective view of a further modification.
Figure 3:
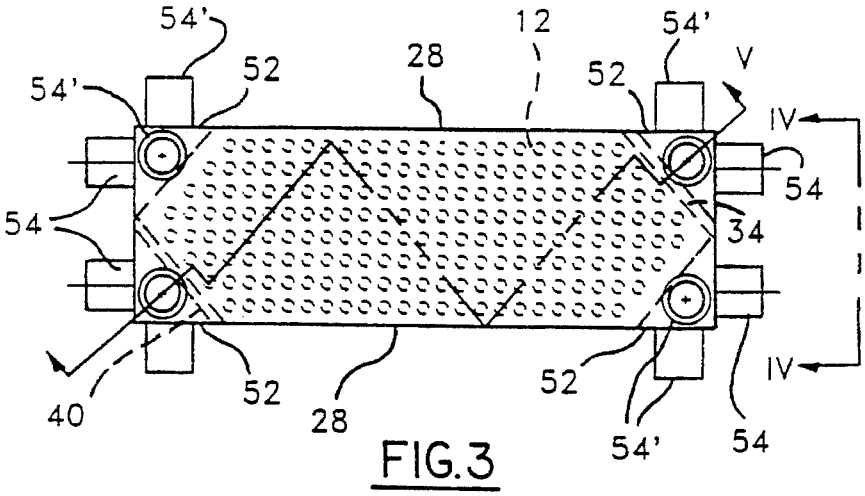
FIG. 3 is a top plan view of the heat exchanger in FIGS. 1, 2 and 2A, with additional modifications.
Figure 5:
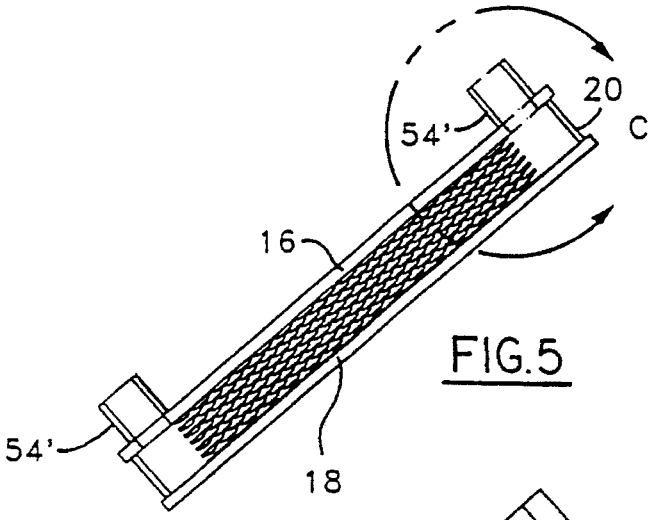
FIG. 5 is a sectional view taken on the line V—V in FIG. 3.
Figure 4:
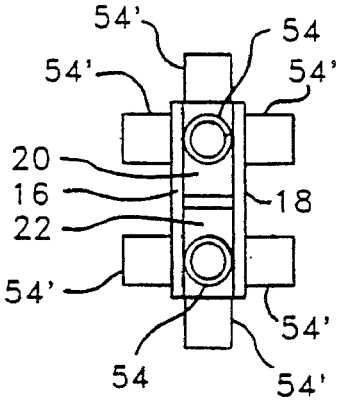
FIG. 4 is an end view of the heat exchanger in FIG. 3, as seen on the line IV—IV in FIG. 3.

FIG. 2B shows a modified construction in which the "A" and "B" plates are corrugated rather than dimpled. The "A" plates 12 have parallel corrugations 64 slanted in one direction and the "B" plates have parallel corrugations 66 slanted oppositely to the corrugations of the "A" plates and contacting the latter at the points of crossing to provide maximum pressure resistance and heat transfer. Otherwise, the heat exchanger in FIG. 2B is like that in FIG. 2A.

Figure 1:
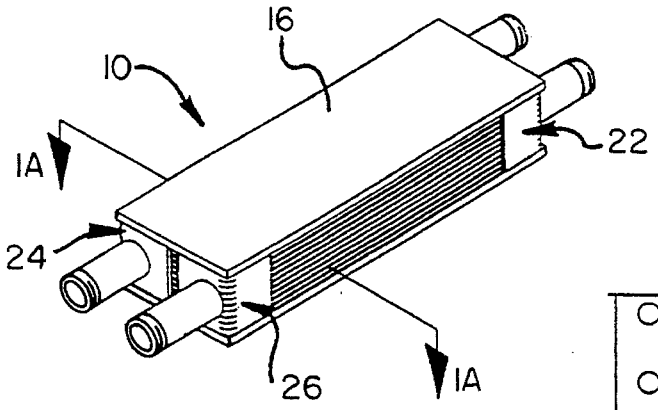
FIG. 1 is a perspective view of a plate heat exchanger embodying the invention.
Figure 1A:
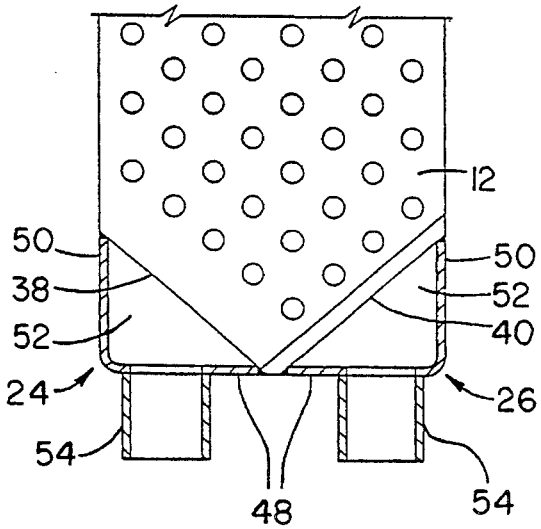
FIG. 1A is a fragmentary sectional view taken on the line 1A—1A in FIG. 1.

FIGS. 3–6 show the heat exchanger of FIGS. 1, 2 and 2A but with added tubular fittings 54' for each manifold. The fitting 54 for each manifold in FIGS. 1, 2 and 2A is retained and the added fittings 54' extend through the longitudinal leg of the end cap and through the top and bottom panels, respectively. The provision of additional fittings is for the convenience of the user, depending on the availability of space for installation. Those fittings not used can be plugged. The heat exchanger may, of course, have only a single fitting for each manifold. FIG. 3–6 illustrate the various locations where this single fitting may be placed, depending on user preference.

Figure 10:
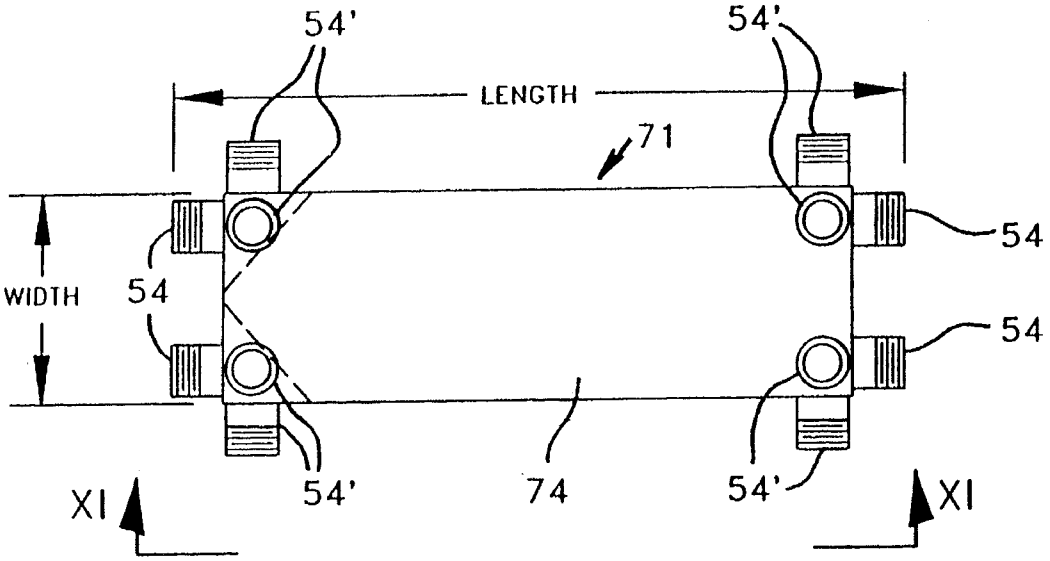
FIG. 10 is a top plan view of a multi-pass heat exchanger.
Figure 12:
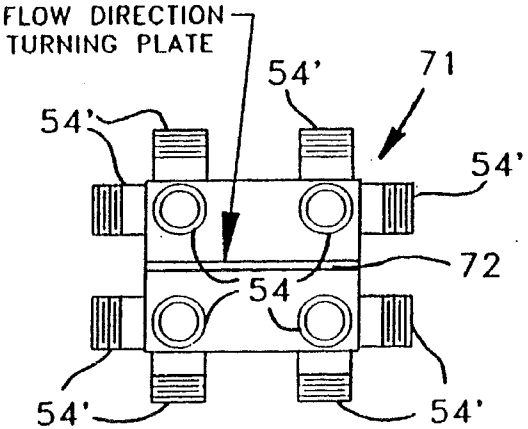
FIG. 12 is a view taken on the line XII—XII in FIG. 11.
Figure 11:
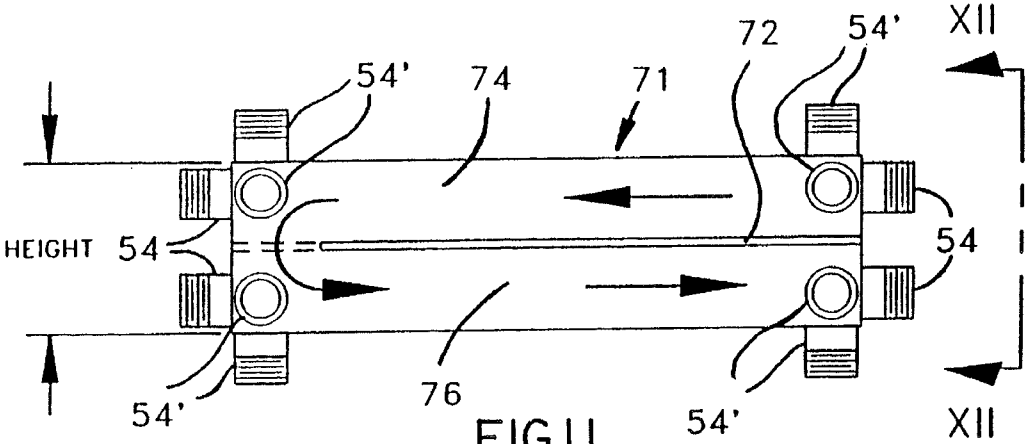
FIG. 11 is a view taken on the line XI—XI in FIG. 10.

FIGS. 10–12 show a multi-pass heat exchanger 71, as distinguished from the single pass heat exchanger in the previously described embodiments. This embodiment illustrates the variety of fittings 54 and 54' which may be employed for the several manifolds, eight manifolds in this instance. The numeral 72 identifies the flow turning plate. It will be understood that the plate packs in the upper and lower portions 74 and 76 will each be constructed essentially as described in the preceding embodiments.

FIGS. 13 through 20 show a modified construction for a heat exchanger designed as a vapor condenser, to condense steam, for example. The vapor condenser shown has a plurality of identical "A" plates 80 and a plurality of identical "B" plates 82. The "A" plates 80 and the "B" plates 82 are rectangular and are stacked in interleaved or alternated relationship, namely ABAB etc. The "A" and "B" plates are shown as having dimpled main body portions, although they could also have crossing corrugated configurations as shown in FIG. 2B, if desired. The stack of "A" and "B" plates is confined in housing 100 between the two cover panels 86 and 88. These "A" and "B" plates are stacked in substantially exact overlying relationship with their side and end edges superimposed.

Figures 13, 14, 15, 16, 17, 18, 19, 20:
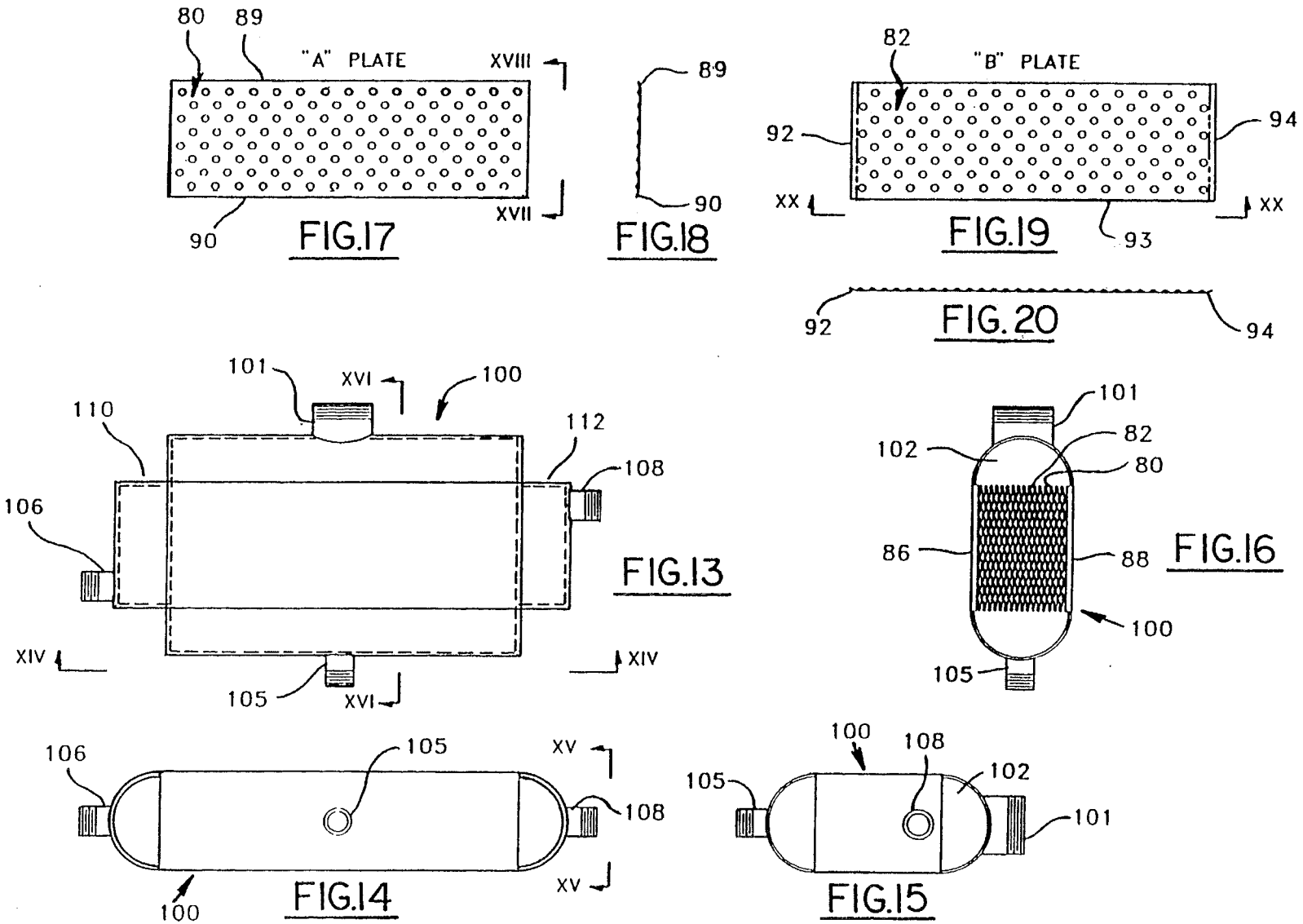
FIG. 13 is an elevational view of a vapor condenser.
FIG. 14 is a view taken on the line XIV—XIV in FIG. 13.
FIG. 15 is a view taken on the line XV—XV in FIG. 14.
FIG. 16 is a sectional view taken on the line XVI—XVI in FIG. 13.
FIG. 17 is a top plan view of a heat transfer plate "A" used in the vapor condenser of FIGS. 13–16.
FIG. 18 is a view taken on the line XVIII—XVIII in FIG. 17.
FIG. 19 is a top plan view of a heat transfer plate "B" used in the vapor condenser of FIGS. 13–16.
FIG. 20 is a view taken on the line XX—XX in FIG. 19.

The opposite edges of the "A" plates along the long sides are bent, as in previous constructions, and these bent edges are shown at 89 and 90 in FIGS. 17 and 18. The "B" plates along the short sides have bent edges 92 and 94 clearly seen in FIGS. 19 and 20. These bent edges are in contact with and welded to the unbent edges of the adjacent plates in the stack to define flow paths for the hot vapor and for the cold liquid and to form enlarged inlet and outlet openings for the flow paths. The "A" plates with bent edges cooperate with "B" plates to form channels for the liquid flow and the "B" plates with bent edges cooperate with "A" plates to form channels for the hot vapor flow. Typically, for vapor condensing service, the heat transfer length for the hot vapor is smaller than for the cold liquid. Note the vapor transfer length in the direction parallel to edges 92 and 94 is smaller than the width 93 of the "B" plate which would constitute a flow channel for condensing vapor.

Incoming hot vapor enters the housing 100 for the unit through the fitting 101 at the top, first entering the manifold area 102 and then crossing through the alternate relatively short flow passages between the plates, exiting at the bottom of the housing through the fitting 105. The fittings 106 and 108 at the opposite ends of the housing conduct cold liquid from the manifolds 110 and 112 across the remaining flow passages for the cold liquid which are the relatively long passages.

It will be noted that the fitting for incoming vapor at the top is large in comparison to the fitting at the bottom because the hot vapor condenses upon passing through the heat exchanger and thus the outlet fitting does not have to be as large as the inlet fitting. The heat exchanger in FIGS. 13–20 has the enlarged inlet and outlet features for the flow passages between plates as previously described in connection with other embodiments. That is, the bending of the opposite edges of the plates and the welding of the bent edges to adjacent plates provides enlarged inlets and outlets for the flow passages between plates which have the advantages previously described. The essential difference is that the bent edges are along opposite sides of rectangular plates, without the triangular formations at the ends of the plates as in previous embodiments. Also, in the construction of FIGS. 13–20, the flow paths cross at right angles, rather than along diagonal lines.

Figure 21:
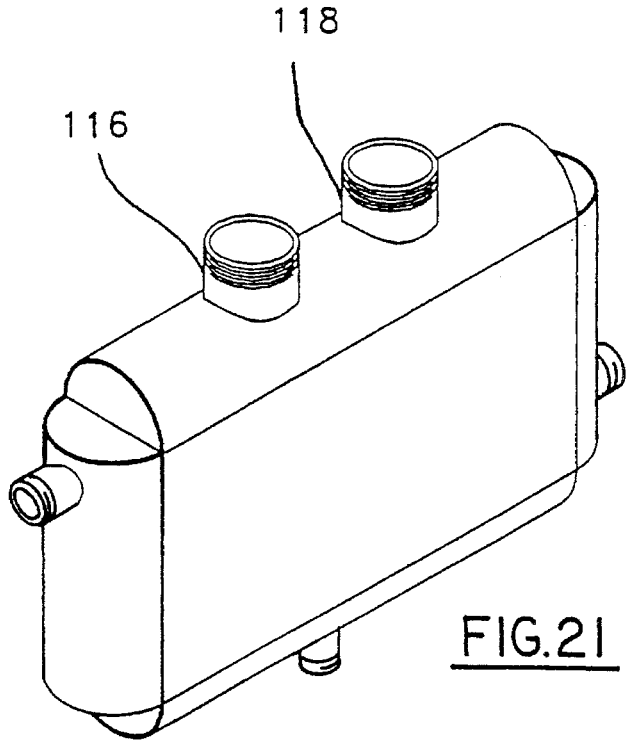
FIG. 21 is a perspective view of a vapor condenser similar to FIG. 13, but with two inlet fittings.

FIG. 21 shows a modification of the embodiment of FIGS. 13–20 in which two vapor inlet fittings 116 and 118 are provided. This embodiment is useful where the single vapor inlet fitting of FIGS. 13–20 is not large enough in cross sectional area to handle the volume required.

Figure 22:
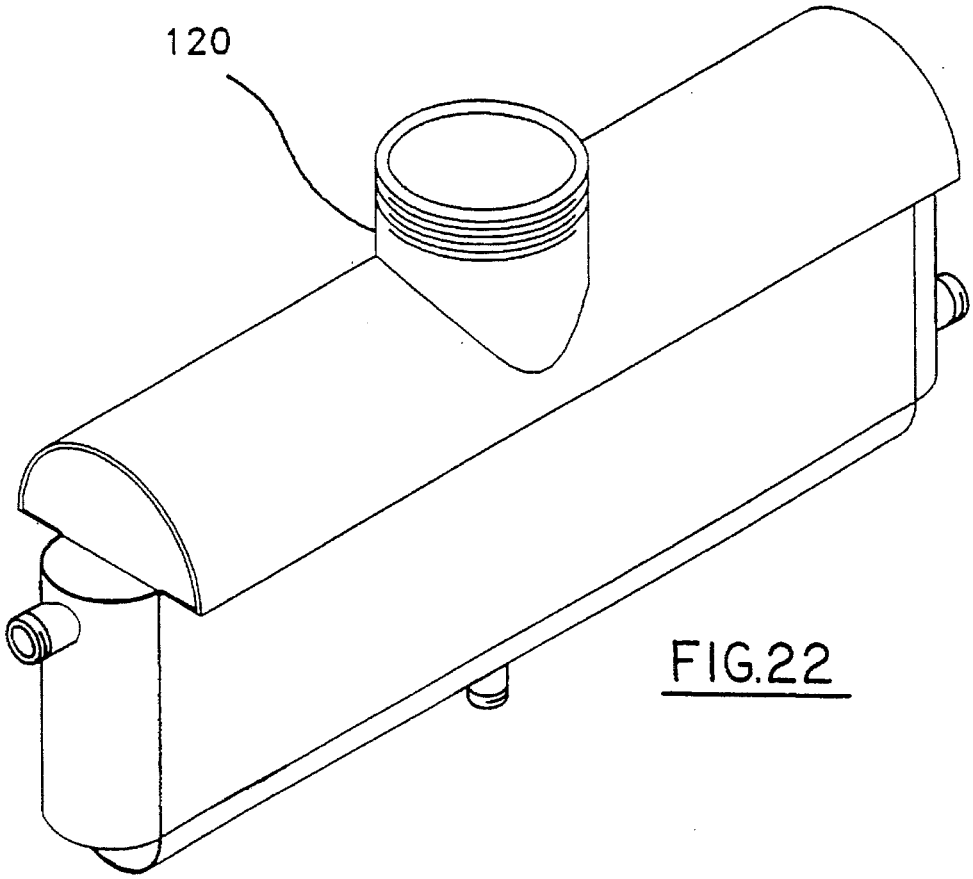
FIG. 22 is a perspective view of a vapor condenser similar to FIG. 13, but with an enlarged inlet fitting.

FIG. 22 shows a further embodiment in which a single vapor inlet fitting 120 is shown, but of much larger cross section than the single fitting in FIGS. 13–20. Some users with large volume requirements prefer only a single fitting rather than the two fittings shown in FIG. 21.

What is claimed is:

1. A plate heat exchanger comprising:

a plurality of first plates and a plurality of second plates with said first plates interleaved with said second plates in an alternating stacked parallel relationship and with spaces between the plates, first fluid passages for a first fluid in alternate spaces and second fluid passages for a second fluid in the remaining spaces, said plates having parallel first and second side edges with the first side edges of the plates sealed together in superimposed registration and the second side edges of the plates sealed together in superimposed registration, said plates having first and second ends with said first ends of said plates provided with first and second end edge portions intersecting to form a V and disposed respectively in superimposed registration and said second ends of said plates provided with first and second end edge portions intersecting to form a V and disposed respectively in superimposed registration, the V at each end of each said plate having an apex on the longitudinal centerline thereof, said first and second end edge portions at one end of said first plates being diagonally opposed to said first and second end edge portions respectively at the other end thereof, said first and second end edge portions at one end of said second plates being diagonally opposed to said first and second end edge portions respectively at the other end thereof, the diagonally opposed first end edge portions at opposite ends of said first plates being inclined away from the plane of said first plates and sealed to said second plates to block said second passages, and provide enlarged first fluid inlets and outlets for said first passages which results in lowering of pressure drop, the diagonally opposed second end edge portions at opposite ends of said second plates being inclined away from the plane of said second plates and sealed to said first plates to block said first passages, and provide enlarged second fluid inlets and outlets for said second passages which results in lowering of pressure drop, a top panel, a bottom panel, said stack of plates being sandwiched between said top and bottom panels, said panels being generally rectangular having four corners and having side edges registering with the side edges of said plates and end edges registering with the apices of the V at the ends of said plates, four end caps cooperating with said top and bottom panels and said plates to form four separate manifolds for fluid entering and exiting said first fluid passages through said first fluid inlets and outlets thereof and for fluid entering and exiting said second fluid passages through said second fluid inlets and outlets thereof, said four end caps being located between said panels and at the four corners respectively of said panels and each being generally L-shaped having side legs which extend along the side edges of said top and bottom panels in contact therewith from one of said corners to and in contact with the side edges of said plates and end legs extending along the end edges of said top and bottom panels in contact therewith from one of said corners to and in contact with the apices of the V at the ends of said plates, whereby said end caps and panels provide a rectangular enclosure for said plates, and fittings for the flow of fluid into and out of said respective manifolds.

2. A plate heat exchanger as defined in claim 1, wherein the first side edges of the plates are sealed together as aforesaid by filler strips and the second side edges of the plates are sealed together as aforesaid by filler strips.

3. A plate heat exchanger as defined in claim 1, wherein the first side edges of the plates are sealed together as aforesaid by integral nesting flanges thereon and the second side edges of the plates are sealed together as aforesaid by integral nesting flanges thereon.

4. A plate heat exchanger as defined in claim 1, wherein each of said manifolds has at least one of said fittings in said top panel, another of said fittings in said bottom panel, and still another of said fittings in each leg of the associated end cap.

5. A plate heat exchanger as defined in claim 1, wherein said plates have essentially flat main body portions, said main body portions of said plates having a plurality of spaced-apart raised dimples contacting an adjacent plate to establish the spaced relationship of said plates and produce turbulence in the flow of fluid through said passages which enhances the heat transfer.

6. A plate heat exchanger as defined in claim 1, wherein each of said plates has a corrugated main body portion providing parallel raised corrugations, the corrugations of alternate plates extending cross-wise of and contacting the corrugations of the remaining plates to establish the spaced relationship of said plates and produce turbulence in the flow of fluid through said passages.

* * * * *